United States Patent [19]

Merchant

[11] Patent Number: 4,635,523

[45] Date of Patent: Jan. 13, 1987

[54] SPRUCE SPRING BRIDGE SUPPORT FOR STRINGED INSTRUMENT

[76] Inventor: William Merchant, 39 Christopher St., Apt. 1C, New York, N.Y. 10014

[21] Appl. No.: 825,253

[22] Filed: Feb. 3, 1986

[51] Int. Cl.[4] ..... G10D 3/04

[52] U.S. Cl. ..... 84/307; 84/309

[58] Field of Search ..... 84/1.16, 267, 298, 299, 84/307-309

[56] References Cited

U.S. PATENT DOCUMENTS

| | | | |
|---|---|---|---|
| 1,447,174 | 3/1923 | Grover | 84/308 |
| 2,082,951 | 6/1937 | Grover | 84/298 |
| 2,455,452 | 12/1948 | Van Eps | 84/309 |
| 2,491,991 | 12/1949 | Lundback | 84/307 |
| 3,539,700 | 11/1970 | Johnson | 84/1.16 |
| 4,242,938 | 1/1981 | Van Zalinge | 84/1.16 |
| 4,512,231 | 4/1985 | Mink | 84/277 |

*Primary Examiner*—Lawrence R. Franklin

*Attorney, Agent, or Firm*—Angelo Notaro

[57] ABSTRACT

A bridge on a bass-violin style instrument is isolated from the solid-filled body of the instrument by support bars contructed so that an air space is provided between each of the bars and the body of the instrument. The support bars are preferably composed of spruce wood.

18 Claims, 5 Drawing Figures

SPRUCE SPRING BRIDGE SUPPORT FOR STRINGED INSTRUMENT

BACKGROUND OF THE INVENTION

This invention relates to improvements in stringed musical instruments and, more particularly, to a new and improved bridge support for an electric stringed instrument, such as an electric bass.

Electric bass-violin style stringed instruments are sometimes designed to simulate the sound of conventional acoustic instruments. Such sound simulation, however, has not been readily achieved. Nevertheless, some professional musicians, who otherwise utilize and prefer to use an acoustic instrument, for example, an acoustic bass, will resort to the use of an electric bass due to the transportation difficulties involved in transporting a much larger acoustic bass, for example, in the restricted space of an airplane or automobile.

In attempting to simulate the sound of an acoustic instrument, it is important that the musician be able to adjust the strings to obtain the proper feel and tonal quality. The strings extend across a bridge which is supported on the body of the bass. The bridge maintains the spacing between the strings and, in some constructions, is moveable and adjustable to vary the elevation and tension of the strings. The bridge is typically provided with support legs. Elevation adjustment may be effected by mechanical adjusters, which engage each support leg and the body of the bass, so as to enable adjustment of the strings above the face of the body.

In the acoustic bass, the bridge moves by virtue of the flex of the body. Such movement affects the tonal quality and, as well, the feel of the strings. The typical vertical electric bass, however, is provided with a solid, i.e., filled, body having a much narrower cross-section and smaller volume than an acoustic bass. Consequently, the electric bass body is relativley rigid so that the bridge does not move in the same way and the feel of the strings and sound generated does not satisfactorily simulate an acoustic bass.

SUMMARY OF THE INVENTION

In accordance with the invention, a bridge on a bass-violin style instrument is isolated from the solid-filled body of the instrument by support bars, made of spruce wood, and constructed so as to allow the bridge to vibrate freely.

Two elongated spruce spring support bars are arranged in parallel with respect to the longitudinal axis of the instrument. The bars, which rest on the instrument body between the strings and the bridge, include air spaces intermediate the support bars and the body so that the supports are operable to vibrate within the respective air spaces as the strings are played. In a preferred embodiment, the air spaces are formed by legs which depend from opposite ends of the bars and bear upon the body. In accordance with further features of the preferred embodiments, the spruce bars are movably mounted to the body so that the longitudinal position of the bars may be adjusted upon releasing of the tension of the strings. The air space between the body and the bridge support on the low string side of the instrument is preferably larger then the air space between the body and the bridge support on the high string side of the instrument. It will be understood, in this regard, that the low string side refers to the side where the string providing the lowest possible note on the instrument is placed.

The bridge used in the inventive arrangement has legs of different length. The adjustment of the bridge distance from the surface of the body may be effected by mechanical adjusters or pegs extending into apertures formed in the bridge and bridge support bar surfaces.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts through the several views.

DETAILED DESCRIPTION

Figure 1:
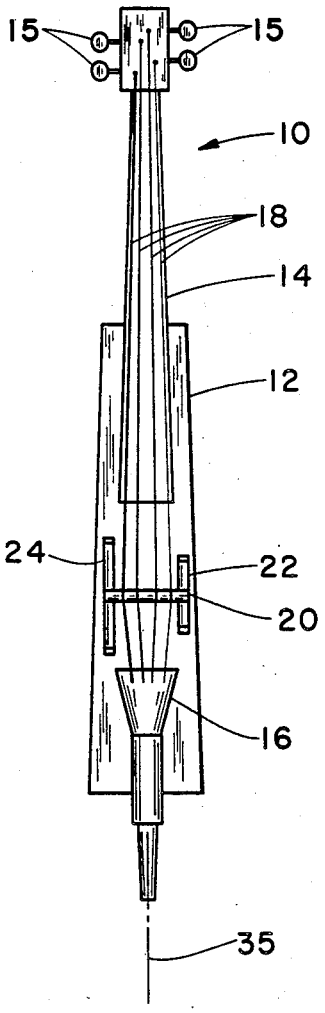
FIG. 1 is a plan view of an electric bass embodying a spruce spring bridge support in accordance with the invention.

FIG. 1 shows an electric stringed musical instrument 10, illustrated in FIG. 1 as a vertical electric bass, which has an elongated solid-filled body 12 and an elongated neck 14 connected to one end of the body 12. The neck 14 includes a peg box 15 at its end opposite the body 12. Four tunable strings 18 are supported on an upstanding bridge 20 mounted laterally and tranversely, across the body 12. The string-supporting bridge 20 maintains the transverse spacing between the strings 18. The strings 18 are adjustably connected, in a well-known manner, at one of their ends to the peg box 15 and at their second ends, in the illustrated embodiment, to a tail piece 16 which is located adjacent to and connected to the end of the body opposite the neck 14 in a known manner. The tensioned strings 18 bear upon and assist in maintaining the bridge 20 in position. The bridge 20 is supported upon a pair of spruce bridge bars 22, 24. The body 12 is preferably filled with a rigid urethane foam 30 (see FIG. 3).

Figure 3:
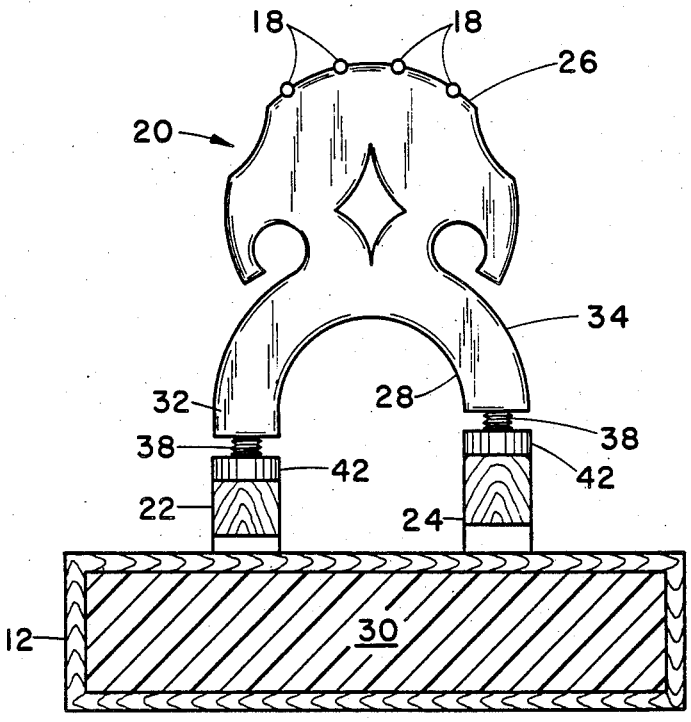
FIG. 3 is a view, partly in section, taken along lines 3—3 of FIG. 2.
Figure 4:
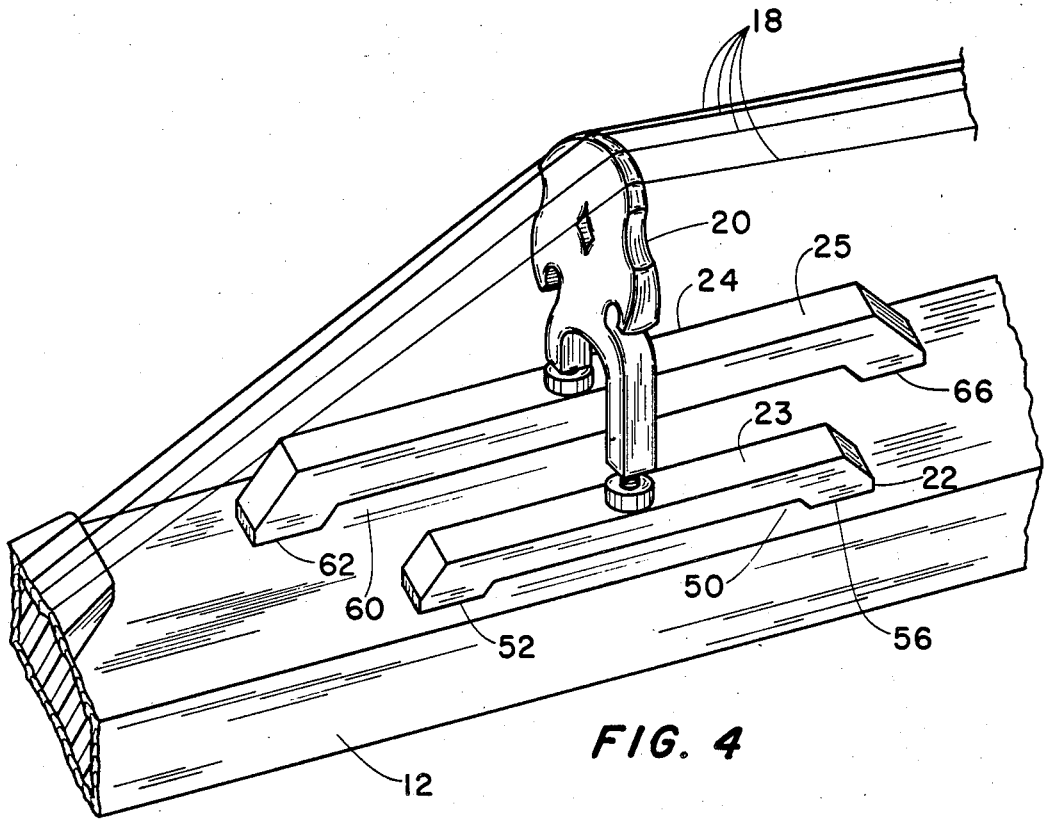
FIG. 4 is a partial perspective view of the spruce spring bridge support of FIG. 1.
Figure 5:
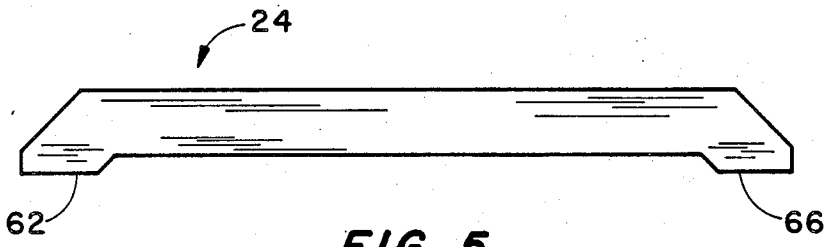
FIG. 5 is a side view of a bridge bar according to an embodiment of the invention.

The bridge 20 is provided with a curved upper edge 26 that includes four transversely spaced grooves of different size within which the strings 18 rest, as is best shown in FIG. 3. The lower end of the bridge 20, opposite the curved upper edge 26, is provided with an arched base 28 including a pair of support legs 32, 34 of unequal length at the opposite ends of the arch.

Mechanical adjusters 36 are attached to the respective support legs 32, 34. Each of the adjusters 36 includes a threaded post 38, the opposite ends of which, in the preferred embodiment, are received in threaded holes (not shown) formed in the support legs 32, 34 and blind holes (not shown) in the bridge bars 22, 24. A knurled ring 42 is threadably engaged to the post 38.

Figure 2:
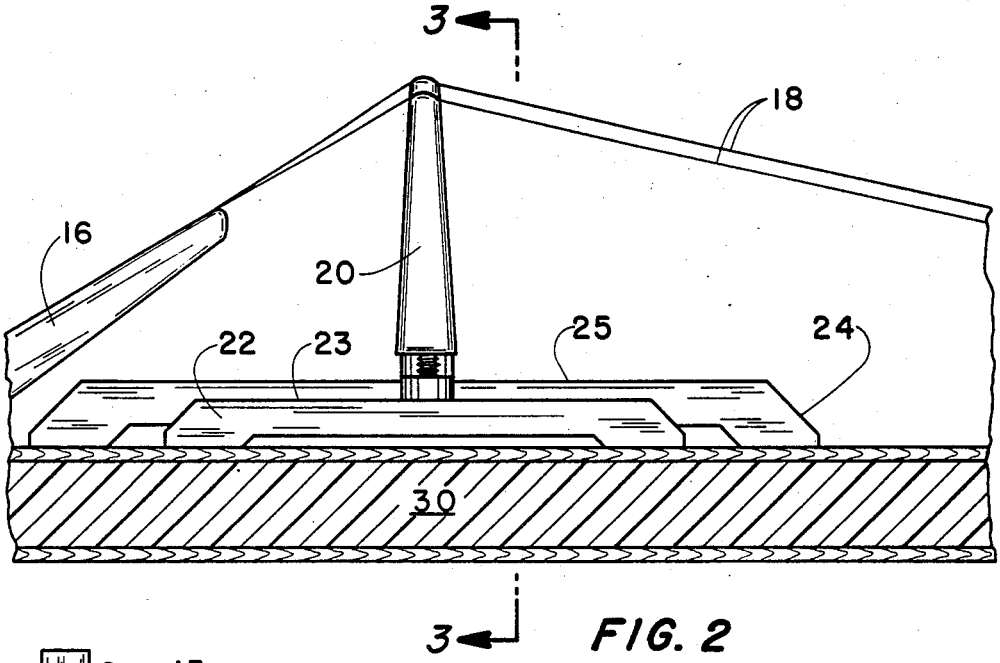
FIG. 2 is a side view of a portion of the bass of FIG. 1.

The ring 42 is rotatable about the post 38 and bears against the bridge bar, or the bridge, to adjust the distance of the bridge 20 and strings 18 above the surface of body 12 in a known manner. The thickness of the bridge 20 tapers from a relatively broad base to a relatively narrower upper edge as shown in FIG. 2.

The bridge 20 is supported by the bridge bars 22, 24 which rest on the body parallel with respect to each other and the longitudinal axis 35 of the instrument, and at right angles to the bridge 20.

In the illustrated embodiment, each of the bridge bars 22,24 is formed with a recess intermediate two downwardly extending and longitudinally-spaced legs 52,56 and 62, 66, respectively, so as to form an air space 50, 60 between the respective bridge bar 22 or 24 and the body 12. The free ends of the legs 52, 56, 62, 66 rest upon the surface of the body 12.

The two bridge bars 22, 24 have different dimensions. The bridge bar 24 that is provided on the low note string side of the instrument, i.e., the side corresponding to the bass bar side of an acoustic bass, is longer than bridge bar 22. The shorter bridge bar 22 is placed on that side of the electric bass which corresponds to the side of an acoustic bass that has a sound post. Moreover, the recess of bridge bar 24 is larger than the recess of bridge bar 22 so that the air space 60 formed between bridge bar 24 and the body 12 is larger than the air space 50 formed between the bridge bar 22 and the body 12. The size of the air space has been found to affect the sound produced by the instrument. The size of the air space is defined by the length, width and depth of the recess in each of the respective bridge bars.

In addition, in the preferred embodiment, bridge bar 24 includes a bridge supporting surface 25 spaced from the surface of the body 12 at a first distance which is greater than the distance between a corresponding bridge supporting surface 23 of bridge bar 22 and the flat surface of the body 12. The bridge 20 is arranged with its larger leg 32 mounted upon the bar surface 23 of the bridge bar 22 which is close to the surface of the body 12 and the short leg 34 mounted upon the surface 25 of the bridge bar 24 which is more distant from the surface of the body 12. In the preferred embodiment the width of the support bars 22, 24, which have a rectangular cross-section, is equal. The referenced width is the dimension of the bars 22, 24 extending transversly in relation to the longitudinal axis 35 of the instrument.

The bridge 20 and bridge bars 22, 24 are assembled and held in place by the forces of the tensioned strings 18. By relaxing the tension of the strings, the bridge bars 22, 24 may be moved back and forth along the body so as to adjust the tone. This enables the musician to simulate the feel obtained in an acoustic instrument and, as well, to adjust the tone of the instrument.

While not preferred, the bridge bars may be fixed to the body 12, for example, by adhesively joining the surfaces of the free ends of the legs 52, 56, 62, 66 with the body 12. In such an arrangement, a plurality of blind holes could optionally be formed in the bridge support surfaces to allow the bridge to be placed at different longitudinal locations on the instrument body.

Each of the bridge bars 22, 24 is made from spruce wood. The construction of the bars from a species of wood such as spruce which compresses and decompresses at different rates is essential to the proper operation of the instrument. The spruce bars 22, 24 function as a spring which compresses and decompresses, at different rates, and which there is vibration in the air spaces. Thus, in operation, the bridge 20 moves in a manner that simulates the movement of a bridge on an acoustic instrument.

Since spruce is a relatively soft wood, the means for receiving the post 38 of adjuster 36 is simply a blind hole drilled into the upper surface of the support bar 22, 24 and threaded holes are formed in the relatively harder wooden material, typically maple, of the bridge 20. Alternatively, it would be possible to provide a thread insert within the blind hole in each bridge bar designed to threadably engage with the post. A further alternative, at least in small instruments, such as a bass viol, would be simply to provide wooden pegs or dowels having a suitable diameter to tightly fit into respective blind holes in the bridge bars and similar blind holes in the bridge. Different length pegs could then be substituted in order to vary the distance of the bridge and strings above the surface of the body of the instrument. The musical instruments in which the improved spruce spring support of the present invention may be employed include an electric vertical bass and a bass viol.

Although the construction of the invention is primarily directed to an electric stringed instrument, the construction can be used to enhance the sound of non-electric viola, cello, violin and other stringed instruments.

I claim:

1. In an electric stringed musical instrument of the type having an elongated neck connected to one end of an elongated solid-filled body, the neck having a peg box at an other end, an upstanding bridge mounted laterally across the body, a plurality of tunable strings at transversly spaced locations mounted on the bridge and adjustably attached under tension at their first ends to the peg box and at their second ends to the body, the improvement comprising a plurality of elongated bridge supports extending parallel with respect to the longitudinal axis of the instrument, the bridge supports resting on the body between the body and the bridge, the bridge supports being made of spruce wood, and each of the bridge supports including space forming means for defining an air space intermediate the respective bridge support and the body, and said bridge supports being operable to vibrate within the air space as the strings are played.

2. The improvement of claim 1 wherein the space forming means includes a pair of longitudinally spaced legs depending from opposite ends of each of the support members and bearing upon the body, and each of the support members having an elongated recess intermediate the pair of depending legs.

3. The improvement as set forth in claim 2 wherein one of the bridge supports has a recess which is larger than the recess of the other bridge support so that the air space formed between the body and the one bridge support is larger than the air space formed between the body and the other of the bridge supports.

4. The improvement as set forth in claim 3 wherein the one bridge support including the larger recess is mounted on the low note string side of the instrument.

5. The improvement as set forth in claim 4 wherein the one bridge support is longer than the other bridge support.

6. The improvement as set forth in claim 5 wherein the one bridge support has a bridge support surface spaced at a first distance from the surface of the body and the other bridge support has a bridge support surface spaced at a second distance from the surface of the body, the first distance being greater than the second distance.

7. The improvement as set forth in claim 6 wherein each of the bridge supports has a rectangular cross-section, and wherein the dimension of each bridge support extending transversely in respect of the longitudinal axis of the instrument is equal.

8. The improvement as set forth in claim 6 wherein the bridge includes a first foot mounted on the one bridge support and a second foot mounted on the other bridge support, the length of the first foot being shorter than the length of the second foot as measured between the strings and the body.

9. The improvement as set forth in claim 8 further comprising means for adjusting the distance between the bridge and the bridge support surface.

10. The improvement as set forth in claim 9 wherein each bridge foot includes an aperture and each bridge support includes an aperture formed in the bridge support surface, and the adjusting means comprises a peg at least partly mounted within an aperture of the bridge foot and an aperture of the bridge support surface.

11. The improvement as set forth in claim 10 wherein the adjusting means includes means for threadably engaging the peg with the bridge and at least one of the bridge supports.

12. The improvement of claim 1 wherein the bridge supports are slidable along the surface of the body upon relaxation of the tension in the strings.

13. The improvement of claim 1 wherein the bridge supports are fixed to the surface of the body.

14. The improvement as set forth in claim 1 wherein the instrument is an electric bass.

15. The improvement as set forth in claim 1 wherein the instrument is a bass viol.

16. In an electric stringed musical instrument of the type having an elongated neck connected to one end of an elongated solid-filled body, the neck having a peg box at an other end, an upstanding bridge mounted laterally across the body, a plurality of tunable strings at transversly spaced locations mounted on the bridge and adjustably attached under tension at their first ends to the peg box and at their second ends to the body, the improvement comprising a plurality of elongated bridge supports extending parallel with respect to the longitudinal axis of the instrument, the bridge supports resting on the body between the body and the bridge, and each of the bridge supports including space forming means for defining an air space intermediate the respective bridge support and the body, and said bridge supports being operable to vibrate within the air space as the strings are played.

17. The improvement as set forth in claim 16 wherein the bridge supports comprise a material which compresses and decompresses at different rates.

18. In stringed musical instrument of the type having an elongated neck connected to one end of an elongated solid-filled body, the neck having a peg box at an other end, an upstanding bridge mounted laterally across the body, a plurality of tunable strings at transversly spaced locations mounted on the bridge and adjustably attached under tension at their first ends to the peg box and at their second ends to the body, the improvement comprising a plurality of elongated bridge supports extending parallel with respect to the longitudinal axis of the instrument, the bridge supports resting on the body between the body and the bridge, the bridge supports being made of spruce wood, and each of the bridge supports including space forming means for defining an air space intermediate the respective bridge support and the body, and said bridge supports being operable to vibrate within the air space as the strings are played.

* * * * *